US010807157B2

(12) United States Patent
Foshag et al.

(10) Patent No.: US 10,807,157 B2
(45) Date of Patent: Oct. 20, 2020

(54) SPRAY APPARATUS AND METHOD FOR COOLING A METAL STRAND IN A CONTINUOUS CASTING MACHINE

(71) Applicants: Siegfried Foshag, Wolfschlugen (DE); Jürgen Frick, Weinstadt (DE)

(72) Inventors: Siegfried Foshag, Wolfschlugen (DE); Jürgen Frick, Weinstadt (DE)

(73) Assignee: LECHLER GMBH, Metzingen (DE)

( * ) Notice: Subject to any disclaimer, the term of this patent is extended or adjusted under 35 U.S.C. 154(b) by 183 days.

(21) Appl. No.: 15/999,187

(22) Filed: Aug. 17, 2018

(65) Prior Publication Data

US 2019/0054520 A1 Feb. 21, 2019

(30) Foreign Application Priority Data

Aug. 18, 2017 (DE) ..... 10 2017 214 450

(51) Int. Cl.

| | |
|---|---|
| ***B22D 11/124*** | (2006.01) |
| ***B22D 11/22*** | (2006.01) |
| ***B05B 12/04*** | (2006.01) |
| *B05B 13/02* | (2006.01) |
| *B05B 1/30* | (2006.01) |
| *B05B 1/20* | (2006.01) |
| *B05B 12/12* | (2006.01) |

(52) U.S. Cl.

CPC ..... *B22D 11/1246* (2013.01); *B05B 12/04* (2013.01); *B22D 11/225* (2013.01); *B05B 1/20* (2013.01); *B05B 1/306* (2013.01); *B05B 1/3053* (2013.01); *B05B 12/12* (2013.01); *B05B 13/0207* (2013.01)

(58) Field of Classification Search

CPC .. B22D 11/124; B22D 11/1246; B22D 11/225
USPC ..... 164/455, 486, 444
See application file for complete search history.

(56) References Cited

U.S. PATENT DOCUMENTS 3,468,362 A 9/1969 Burkhardt et al.
3,727,673 A * 4/1973 Gallucci ..... B22D 11/1281 164/442

(Continued)

FOREIGN PATENT DOCUMENTS

EP 2 714 304 B1 4/2014
GB 2 322 573 A 9/1998

(Continued)

OTHER PUBLICATIONS

Office Action of European Patent Office issued in European Application No. 18 18 8503 with English translation of category of cited documents dated Jan. 23, 2019 (10 pages).

(Continued)

*Primary Examiner* — Kevin P Kerns
(74) *Attorney, Agent, or Firm* — Flynn Thiel, P.C.

(57) ABSTRACT

A spray apparatus for cooling a metal strand in a continuous casting machine, wherein at least one multiple-nozzle head and at least one switching valve are provided, wherein the multiple-nozzle head has at least a first and a second nozzle, wherein the switching valve is arranged upstream of the multiple-nozzle head, and wherein the switching valve is flow-connected to all the second nozzles in the multiple-nozzle head, in order to enable or to shut off a supply of spray liquid to all the second nozzles.

23 Claims, 3 Drawing Sheets

(56) References Cited

U.S. PATENT DOCUMENTS

| | | | | |
|---|---|---|---|---|
| 3,885,741 | A * | 5/1975 | Wagener et al. | ..... B05B 1/044 239/268 |
| 4,247,047 | A | 1/1981 | Schaming | |
| 7,181,822 | B2 | 2/2007 | Ondrovic et al. | |

FOREIGN PATENT DOCUMENTS

| | | | |
|---|---|---|---|
| JP | 57-41864 | A | 3/1982 |
| JP | 57-47560 | A | 3/1982 |
| JP | 61-49760 | A | 3/1986 |
| JP | 480645 | U | 7/1992 |
| JP | 2007253202 | A | 10/2007 |
| SU | 1773552 | A1 | 11/1992 |
| WO | 8605724 | A1 | 10/1986 |
| WO | WO 2017/042059 | A1 | 3/2017 |

OTHER PUBLICATIONS

Office Action of Japan Patent Office issued in corresponding Application No. 2018-153875 with English translation, dated Aug. 6, 2019 (5 pages).
Russian Office Action dated Jun. 17, 2019 (7 pages).
Office Action of German Patent Office issued in German Application No. 10 2017 214 450.5 dated Jun. 6, 2018 (4 pages).
Lechler Katalog, Precision Spray Nozzles and Accessories Edition ASEAN, Mar. 17, 2017, full catalog pages (92 pages).
Lechler Katalog, Precision Spray Nozzles and Accessories Edition ASEAN, Mar. 17, 2017, catalog pp. 8 and 17 only.
Office Action of the Canadian Patent Office issued in Canadian Application No. 3,012,932, dated Mar. 12, 2020 ( 4 pages).

* cited by examiner

SPRAY APPARATUS AND METHOD FOR COOLING A METAL STRAND IN A CONTINUOUS CASTING MACHINE

CROSS-REFERENCE TO RELATED APPLICATIONS

This claims priority from German Patent Application No. 10 2017 214 450.5, filed on Aug. 18, 2017, the disclosure of which is hereby incorporated by reference in its entirety.

TECHNICAL FIELD

The invention relates to a spray apparatus and to a method for cooling a metal strand in a continuous casting machine.

BACKGROUND

European patent EP 2 714 304 B1 discloses a method for cooling a metal strand in a continuous casting machine, wherein a spray jet is applied to a metal strand by means of a plurality of spray nozzles. In order for it to be possible to vary a spray-liquid quantity over as wide a range as possible, the spray nozzles are designed for a maximum dischargeable water quantity and, in order for the spray-liquid quantity to be reduced, are activated intermittently by means of switching valves. In order for a predetermined spray-liquid quantity which is below a maximum dischargeable spray-liquid quantity to be set, the spray nozzles are therefore always operated intermittently. The intermittent action on the metal strand inevitably also means that the latter is not cooled continuously.

SUMMARY

The invention is intended to improve a spray apparatus and a method for cooling a metal strand in a continuous casting machine.

For this purpose, the invention provides a spray apparatus for cooling a metal strand in a continuous casting machine, wherein at least one multiple-nozzle head and at least one switching valve are provided, wherein the multiple-nozzle head has at least a first and a second nozzle, and wherein the switching valve is arranged upstream of the multiple-nozzle head, wherein the switching valve is flow-connected to all the second nozzles in the multiple-nozzle head, in order to enable or to shut off a supply of spray liquid to all the second nozzles. It is preferable for a plurality of multiple-nozzle heads to be provided and for the multiple-nozzle heads to be spaced apart from one another in three dimensions.

The spray apparatus according to the invention therefore achieves a variation in the spray-liquid quantity discharged by virtue of nozzles in the multiple-nozzle heads being switched on or off. In the case of a predetermined and constant spray-liquid quantity, however, the selected nozzles are activated permanently, rather than intermittently, by the selected spray-liquid pressure. This makes it possible to achieve continuous operation of the nozzles and therefore also continuous cooling of the metal strand. The nozzles in the multiple-nozzle head here are designed, and arranged, such that each nozzle on its own gives rise, and also any desired combinations of the nozzles give rise, to a uniform distribution of spray liquid over the width of the metal strand and therefore to homogeneous cooling of the strand. This is achieved, inter alia, by the spray jets of the nozzles overlapping. It is possible here for the switching valves to be designed, for example, in the form of pneumatic switching valves and to be activated, for example, via the level of the pressure of a compressed air supplied. If, for example, in each case three nozzles are present in the multiple-nozzle heads, the two or three switching valves which are then present can then be designed such that, at a first pressure, for example 6 bar, it is only the first nozzles which are supplied with spray liquid. If the pressure of the compressed air supplied is then lowered, for example to 3 bar, the switching valves open not just for the first nozzles, but also for the second nozzles, and therefore spray liquid is then discharged from the first nozzles and the second nozzles. If the pressure of the compressed air supplied is reduced further, for example to 0 bar, all three switching valves open, and therefore spray liquid is then discharged through the first nozzles, through the second nozzles and the third nozzles in the multiple-nozzle heads. As an alternative, the switching valves can also be activated electrically or electronically, the switching valves used being, for example, solenoid valves. It is likewise possible to combine switching valves designed in the form of compressed-air valves with solenoid valves, which then subject the switching valves to the action optionally of compressed air in order to alter the switching state thereof. A great advantage of the spray apparatus according to the invention is that the spray-liquid quantity discharged can be varied over a very wide range, the spray liquid nevertheless being discharged continuously. It is also possible for the spray-liquid quantities discharged to be varied by a straightforward changeover of nozzle inserts in the multiple-nozzle heads. Variation of the spray-liquid quantity discharged can then take place, on the one hand, via the pressure of the spray liquid supplied and, on the other hand, via individual nozzles in the multiple-nozzle heads being switched on or off. This can achieve a very wide range of variation of the spray-liquid quantity of, for example, 1:15. It is possible for the first nozzle to be supplied permanently with spray liquid or for the first nozzle likewise to be assigned a switching valve. The switching valves can be designed such that nozzles in which the supply of spray water is shut off are flushed through permanently or to some extent with compressed air, this preventing deposits and contamination in nozzles and pipelines. For this purpose, the switching valves can be provided with a branch for the compressed air and, possibly, with a throttle for the compressed air in the branch. It is possible for each multiple-nozzle head to be provided with one or more switching valves, or a plurality of multiple-nozzle heads are assigned to one or more switching valves.

In a development of the invention, each multiple-nozzle head has n nozzles, wherein all the second nozzles and possibly all the third, fourth to nth nozzles are each flow-connected to a switching valve, in order to enable or to shut off a supply of spray liquid to all the second nozzles and possibly all the third, fourth to nth nozzles, where n is a natural number and has a value between 2 and 10.

There is basically any desired number of nozzles in the multiple-nozzle heads, where n is advantageously equal to 3, in which case three nozzles are present in each multiple-nozzle head and a first switching valve is assigned to all the first nozzles, a second switching valve is assigned to all the second nozzles and a third switching valve is assigned to all the third nozzles. Particularly advantageous values for n are between 2 and 10. The first switching valve can be dispensed with if the first nozzles are to be supplied permanently with spray liquid.

In a development of the invention, at least a first pipeline and a second pipeline are provided for supplying spray liquid, wherein the first pipeline is connected to all the first nozzles and the second pipeline is connected to all the second nozzles. The first switching valve can be provided, upstream of the multiple-nozzle heads, on the first pipeline and the second switching valve can be provided, upstream of the multiple-nozzle heads, on the second pipeline.

A highly space-saving construction of the spray apparatus according to the invention can be achieved by the provision of pipelines and by all the first nozzles in the multiple-nozzle heads being supplied via a joint first pipeline and all the second nozzles in the multiple-nozzle heads being supplied via a joint second pipeline. In continuous casting machines, it is necessary for the nozzles for cooling a metal strand usually to be arranged between supporting rollers for the metal strand, and therefore there is usually only a very small amount of space in which to arrange the nozzles. A further, considerable advantage of joint pipelines is that each pipeline has to be assigned in each case only a single switching valve. The design-related outlay can thus be reduced to a considerable extent. It is possible for the first pipeline to be supplied permanently with spray liquid, in which case the first switching valve can be dispensed with. If n nozzles are provided in each multiple-nozzle head, there are also n pipelines present, wherein a respective pipeline is assigned to all the first, second, third and/or nth nozzles.

In a development of the invention, upstream of the multiple-nozzle heads, a respective switching valve is provided on the second pipeline and possibly on the third, fourth to nth pipeline, where n is a natural number and has a value between 2 and 10. It is also possible, upstream of the multiple-nozzle heads, for a switching valve to be provided on the first pipeline.

For example, n=3, in which case three pipelines are provided and in each case three nozzles are provided in all the multiple-nozzle heads. At least two of the three lines are respectively assigned a switching valve, and therefore it is possible for a supply of spray liquid through the first pipeline either to be enabled permanently or to be shut off or enabled by means of the first switching valve, for a supply of spray liquid through the second pipeline to be shut off or enabled by the second switching valve and for a supply of spray liquid through the third pipeline to be shut off or enabled by means of the third switching valve. If a switching valve is present in the first pipeline, it is thus possible for all the first nozzles in the multiple-nozzle heads to be switched on or off jointly, in the same way as all the second nozzles and/or all the third nozzles in the multiple-nozzle heads. Particularly advantageous values for n are between 2 and 10.

In a development of the invention, the nozzles of at least one multiple-nozzle head differ to the extent where, at a predefined pressure of the spray liquid, they each discharge a different quantity of spray liquid.

Such a graduation of the nozzle sizes in the multiple-nozzle heads can achieve an even greater spread of the spray-liquid quantity which can be discharged by the spray apparatus according to the invention than is the case with identical nozzles.

In a development of the invention, the nozzles of a multiple-nozzle head are coordinated with one another in respect of the spray-liquid quantity discharged such that the first nozzle, within a predefined pressure range between a low pressure and a high pressure of the spray liquid, discharges a spray-liquid quantity within a first quantity range, and that the quantity range made up of the sum of the spray-liquid quantities discharged by the first nozzle and the second nozzle between the low pressure and the high pressure overlaps the first quantity range.

This makes it possible to cover a very wide range of spray-liquid quantities, without it not being possible, within this range, to cover or discharge certain values. In other words, the second quantity range, which is defined by the spray-liquid quantity discharged by the first nozzle and the second nozzle together between the low pressure and the high pressure, overlaps the first quantity range at least at the high pressure.

In a development of the invention, each multiple-nozzle head has n nozzles, wherein possibly the first to third nozzle, the first to fourth nozzle and/or the first to nth nozzle, within a predefined pressure range between a low pressure and a high pressure of the spray liquid, discharge a spray-liquid quantity within a third, fourth and/or nth quantity range, and the quantity ranges overlap.

It is also the case here that n is advantageously equal to 3, further advantageous values of n being between 2 and 10. The second quantity range and the third quantity range therefore overlap, as is also the case for the third and fourth and/or (n−1)th and nth quantity ranges.

In a development of the invention, the multiple-nozzle heads are spaced apart from one another in three dimensions along the pipelines.

This can achieve a compact, space-saving construction of the spray apparatus according to the invention. The pipelines advantageously run parallel to one another. All that is then required is for short branch lines to run from the parallel pipelines to the nozzles of the multiple-nozzle heads.

In a development of the invention, the pipelines run parallel to a casting direction of the continuous casting machine and the multiple-nozzle heads are arranged along the pipelines, one behind the other in the casting direction.

If a plurality of spray apparatuses according to the invention are arranged one beside the other in the casting direction, then it is possible, by virtue of individual spray apparatuses being switched off, to vary the width over which the spray apparatuses according to the invention act, corresponding to the width of the metal strand which has just been cast.

In a development of the invention, the pipelines are arranged transversely to a casting direction of the continuous casting machine and the multiple-nozzle heads are arranged along the pipelines, one behind the other transversely to the casting direction.

Depending on the application case envisaged, the pipelines can also advantageously be laid transversely to the casting direction. A casting direction here is intended to mean an advancement direction of the metal strand.

In a development of the invention, the switching valves are designed in the form of compressed-air valves, and each switching valve is assigned a solenoid valve for enabling or shutting off a supply of compressed air to a respective switching valve.

This makes it possible to achieve an arrangement which, at first glance, appears to involve a high level of design-related outlay, but which is very reliable in operation. Compressed-air valves can also perform their function reliably in harsh environmental conditions. Solenoid valves, in contrast, can be readily activated electronically and can also be straightforwardly integrated in a higher-level process control system. The combination of electronically activatable solenoid valves with compressed-air valves therefore ensures an easy-to-integrate and very operationally reliable design of the spray apparatus according to the invention.

In a development of the invention, a plurality of solenoid valves are combined in a solenoid-valve island, wherein the solenoid-valve island has a joint base and a joint electronic control means for the solenoid valves.

This makes it possible to achieve a compact construction. The solenoid-valve island and/or the joint electronic control means of the solenoid-valve island may be suitable for connection to a data-bus line, and it is therefore also possible to achieve very straightforward electronic wiring.

In a development of the invention, at least one of the pipelines is designed in the form of a profile with at least one hollow chamber which is continuous in the longitudinal direction of the profile.

Use can be made, for example, of an extruded profile which consists, for example, of aluminium, brass or also of steel, in particular of stainless steel. The pipelines can thus be of very stable design and, for example, the profiles can even provide fastening means for the multiple-nozzle heads.

In a development of the invention, a plurality of pipelines are formed by means of a profile with a plurality of hollow chambers which are continuous in the longitudinal direction.

This makes it possible to achieve a very compact design of the spray apparatus according to the invention.

In a development of the invention, a plurality of profiles are connected to form a support.

In a development of the invention, the multiple-nozzle heads are arranged on the profile or on the support having a plurality of profiles.

By virtue of the support being formed, it is thus possible for the pipelines to be designed, at the same time, in the form of mechanically supporting parts.

The problem on which the invention is based is also solved by a method for cooling a metal strand in a continuous casting machine by means of a spray apparatus according to the invention, wherein the method provides the steps of enabling a supply of spray liquid, and/or of switching off a supply of spray liquid, to all the first nozzles, all the second nozzles and/or all the nth nozzles of the multiple-nozzle heads in dependence on a spray-liquid quantity required, wherein the operation of enabling and/or switching off the supply of spray liquid is carried out exclusively when the spray-liquid quantity required is altered.

The spray-liquid quantity discharged by means of the nozzles can thus be varied very widely by the method according to the invention, wherein at the same time, if the spray-liquid quantity is constant, spray liquid acts continuously on the metal strand and continuous cooling is thus also achieved. It is only when the spray-liquid quantity is altered that individual nozzles can then be switched on or off.

BRIEF DESCRIPTION OF THE DRAWINGS

Further features and advantages of the invention can be gathered from the claims and from the following description of preferred embodiments of the invention in conjunction with the drawings. Individual features of the different embodiments of the invention which are shown in the drawings, and described in the description, can be combined with one another in any desired manner here without departing from the framework of the invention. This also applies to a combination of individual features without any further features with which the individual features are described, or shown, together. In the drawings:

DETAILED DESCRIPTION

Figure 1:
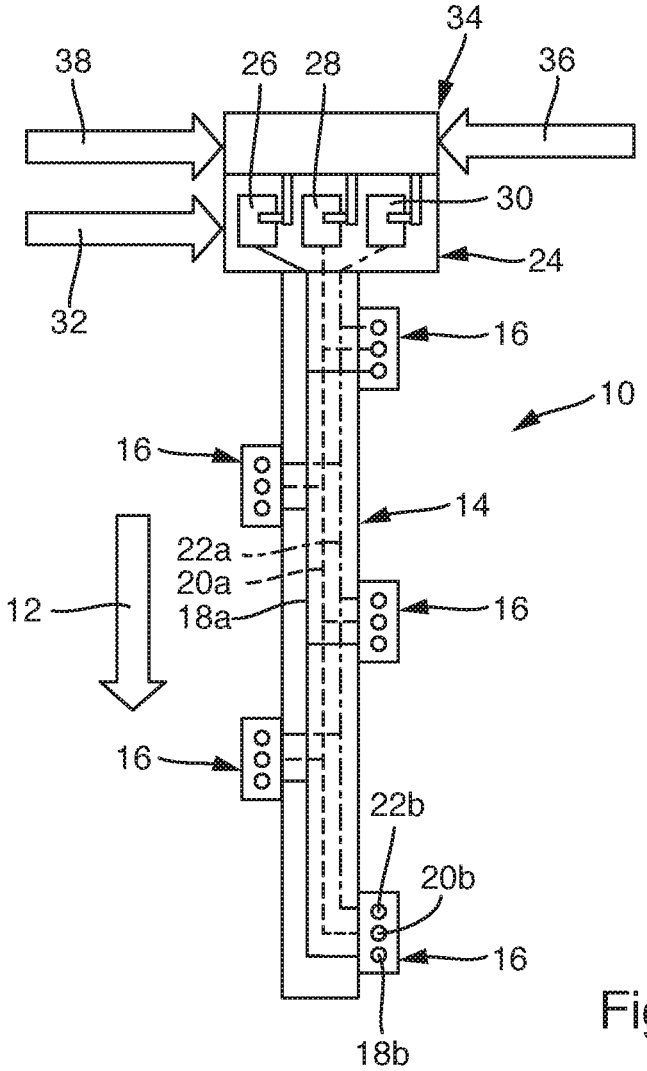
FIG. 1 shows a schematic illustration of a first embodiment of a spray apparatus according to the invention.

The illustration of FIG. 1 shows a spray apparatus 10 according to the invention which is provided in order to be arranged in a continuous casting machine in which a metal strand is generated. A casting direction of the metal strand is illustrated by an arrow 12. The casting direction 12 corresponds to the advancement direction of the metal strand. For example, the metal strand is cast from liquid steel and then transported onwards, in the direction of the arrow 12, between supporting rollers. The spray apparatus according to the invention, then, is arranged above the metal strand, and a further spray apparatus 10 according to the invention can be arranged beneath the metal strand, in order for it to be possible for the latter to be cooled from the upper side and the underside. A plurality of spray apparatuses 10 according to the invention can be arranged one beside the other, in order for it also to be possible to cool, for example, very wide metal strands over the entire surface area thereof.

Figure 2:
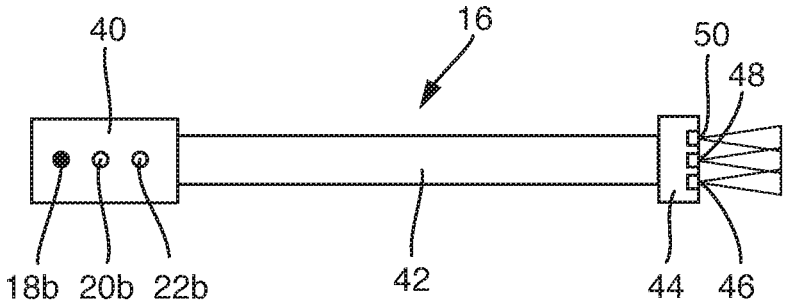
FIG. 2 shows a schematic illustration of a multiple-nozzle unit with a multiple-nozzle head of the spray apparatus from FIG. 1.

The spray apparatus 10 according to the invention has a nozzle support 14, which extends parallel to the casting direction 12. A plurality of multiple-nozzle units 16, which will be explained in more detail in FIG. 2, are arranged on said nozzle support 14. In the case of the embodiment illustrated, a total of five multiple-nozzle units 16 are arranged on the nozzle support 14. Essentially any desired number of multiple-nozzle units 16 are arranged on the nozzle support, and they are arranged on the nozzle support 14 in essentially any desired manner. In the case of the embodiment illustrated, three multiple-nozzle units 16 are arranged on the right-hand side of the nozzle support 14 and two multiple-nozzle units 16 are arranged on the left-hand side of the nozzle support 14. This arrangement is provided merely by way of example and can be selected essentially as desired. It is possible for the multiple-nozzle units 16 to be connected permanently to the support 14 or to be connected in a releasable manner to the support 14.

The nozzle support 14 is arranged in a continuous casting machine, above the supporting rollers for the metal strand. The multiple-nozzle units 16 then extend away downward from the nozzle support 14, that is to say into the drawing plane of FIG. 1, and therefore the spray nozzles can then be arranged, for example, between the supporting rollers for the metal strand.

The nozzle support 14 contains within it a first pipeline 18*a*, a second pipeline 20*a* and a third pipeline 22*a*, the pipelines running parallel to one another and parallel to the nozzle support 14. The first pipeline 18*a* is illustrated by means of a solid line, the second pipeline 20*a* is illustrated by means of a dashed line and the third pipeline 22*a* is illustrated by means of a chain-dotted line. This serves merely for illustrative purposes and for distinguishing between the three pipelines 18*a*, 20*a*, 22*a*.

Each multiple-nozzle unit 16 has three spray nozzles, each activated by separate nozzle water pipes. In order for it to be possible to show this in the schematic illustration of FIG. 1, three nozzle water pipes 18*b*, 20*b* and 22*b* have been illustrated in each multiple-nozzle unit 16. The nozzle water pipes 18*b* of all the multiple-nozzle units 16 are connected to the pipeline 18*a* via short branch lines. The nozzle water pipes 20*b* of all the multiple-nozzle units 16 are connected to the second pipeline 20*a* via short branch lines, and the nozzle water pipes 22*b* of all the multiple-nozzle units 16 are connected to the third pipeline 22*a* via short branch lines. If the pipelines 18*a*, 20*a*, 22*a* and the support 14 are designed in a suitable manner, it is possible to dispense with the branch lines.

A nozzle valve block 24 with a total of three switching values 26, 28 and 30 is provided upstream of the multiple-nozzle units 16. The first switching valve 26 is connected to the first pipeline 18*a*, the second switching valve 28 is connected to the second pipeline 20*a* and the third switching valve 30 is connected to the third pipeline 22*a*. The three switching valves 26, 28, 30 can enable or shut off a supply of spray liquid, for example a supply of water, symbolized by an arrow 32, to the pipelines 18*a*, 20*a*, 22*a*. The switching valves 26, 28, 30 here are advantageously designed in the form of pneumatically activated pinch valves. The switching valves 26, 28, 30 are activated pneumatically by means of a respective solenoid valve, the solenoid valves being arranged in a solenoid-valve island 34, which is illustrated above the nozzle valve block 24. This solenoid-valve island 34 is supplied with compressed air, as is symbolized by means of an arrow 36. Furthermore, the solenoid-valve island 34 has a joint electronic control means, which can be connected to a data bus. Such a data bus, and therefore the supply of electric signals, is symbolized by means of an arrow 38. Within the framework of the invention, the first switching valve 26 can be dispensed with if the intention is for the first pipeline 18*a*, and therefore all the first nozzles of the multiple-nozzle units 16, to be supplied permanently with spray liquid. Of course, it is nevertheless possible to provide a higher-level device for switching on and off the supply of spray water for the spray apparatus 10 as a whole.

Depending, therefore, on how the solenoid valves in the solenoid-valve island 34 are activated, said valves enable a supply of compressed air to the switching valves 26, 28, 30 or shut off the supply of compressed air and, as a result, a supply of spray liquid to the pipelines 18*a*, 20*a*, 22*a* is then also optionally enabled or shut off.

FIG. 2 shows a schematic illustration of a multiple-nozzle unit 16. Each multiple-nozzle unit 16 has a mounting block 40, in which the beginning of each of the nozzle water pipes 18*b*, 20*b* and 22*b* is arranged. The nozzle water pipes 18*b*, 20*b*, 22*b* then lead through a support 42 to a multiple-nozzle head 44. This multiple-nozzle head 44 contains three nozzles 46, 48, 50, which can each generate a spray jet indicated schematically in FIG. 2. If all three nozzles 46, 48, 50 are in operation, then the spray jets of the nozzles 46, 48, 50 overlap. Irrespective of whether only one of the nozzles 46, 48, 50 is in operation or any desired combinations of the nozzles 46, 48, 50 are in operation, a homogeneous distribution of spray liquid is always achieved, as is homogeneous cooling of the entire width of the metal strand. The multiple-nozzle unit 16 is connected in a permanent or releasable manner to the support 14 by way of the mounting block 40.

The multiple-nozzle head 44 here is of such a compact design that it can be arranged between two supporting rollers for the metal strand. The multiple-nozzle head 44 is always designed, and arranged, such that the spray jets generated by the nozzles 46, 48, 50 can pass through between the supporting rollers without obstruction.

The first nozzle 46 is supplied with spray liquid by means of the first nozzle water pipe 18*b*, the second nozzle 48 is supplied with spray liquid by means of the second nozzle water pipe 20*b* and the third nozzle 50 is supplied with spray liquid by means of the third nozzle water pipe 22*b*. Ultimately, therefore, all the first nozzles 46 in the multiple-nozzle units 16 are flow-connected to the first pipeline 18*a*, but it is not the case that all the first nozzles 46 are flow-connected to the second pipeline 20*a* and the third pipeline 22*a*. In the same way, all the second nozzles 48 of the multiple-nozzle units 16 are flow-connected exclusively to the second pipeline 20*a*. All the third nozzles 50 of the multiple-nozzle units 16 are flow-connected exclusively to the third pipeline 22*a*.

By means of the first switching valve 26, it is therefore possible to enable or shut off a supply of spray liquid to all the first nozzles 46 in the multiple-nozzle units 16. By means of the second switching valve 28, it is possible to enable or shut off a supply of spray liquid to all the second nozzles 48 in the multiple-nozzle units 16. By means of the third switching valve 30, it is possible to enable or shut off a supply of spray liquid to all the third nozzles 50 of the multiple-nozzle units 16.

If it is therefore the case that merely a comparatively small spray-liquid quantity is required in order to cool a metal strand, then use is made merely of the nozzles supplied permanently with spray liquid or a higher-level control means (not illustrated) enables a supply of spray liquid into the first pipeline 18*a*, for example, merely via the switching valve 26, whereas a supply of spray liquid into the second pipeline 20*a* and the third pipeline 22*a* is shut off by means of the switching valves 28, 30. As a result, only the first nozzles 46 will discharge a spray jet. The spray jet is discharged through the first nozzles 46 here continuously and without interruption. It is only when the spray-liquid quantity required alters that, on the one hand, it is possible, using devices which are not illustrated, to alter a pressure of the spray liquid supplied. On the other hand, it is possible for all the second nozzles 48 to be switched on, for example, via the second switching valve 28. If even more spray liquid is required, it is possible for all the third nozzles 50 to be switched on, for example, via the third switching valve 30.

The spray-liquid quantity discharged can therefore be altered, on the one hand, by virtue of the pressure of the spray liquid supplied being altered and, on the other hand, by virtue of the nozzles 46, 48, 50 being switched on or off. If the predetermined spray-liquid quantity is constant, the nozzles 46, 48, 50 generate a continuous and uninterrupted spray jet. It is therefore also possible for the metal strand to be cooled continuously and without interruption.

It is possible for the first nozzles 46, the second nozzles 48 and the third nozzles 50 in each multiple-nozzle head 44 here to be identical or designed such that they discharge a different spray-liquid quantity at the same spray-liquid pressure. For example, the first nozzle 46 discharges a first spray-liquid quantity at a predetermined spray-liquid pressure, the second nozzle 48 discharges a greater spray-liquid quantity at the same spray-liquid pressure and the third nozzle 50 discharges an even greater spray-liquid quantity at the same spray-liquid pressure.

This means that the spread of the dischargeable spray-liquid quantity can be increased to a considerable extent in relation to three identically designed nozzles 46, 48, 50.

The nozzles 46, 48, 50 can be formed in the multiple-nozzle block 44, for example, in the form of nozzle inserts, and therefore these nozzle inserts can be changed over quickly and straightforwardly. This is advantageous if the nozzles 46, 48, 50 have to be changed over on account of wear, but also for the purpose of adapting the spray-liquid quantity discharged.

Figure 3:
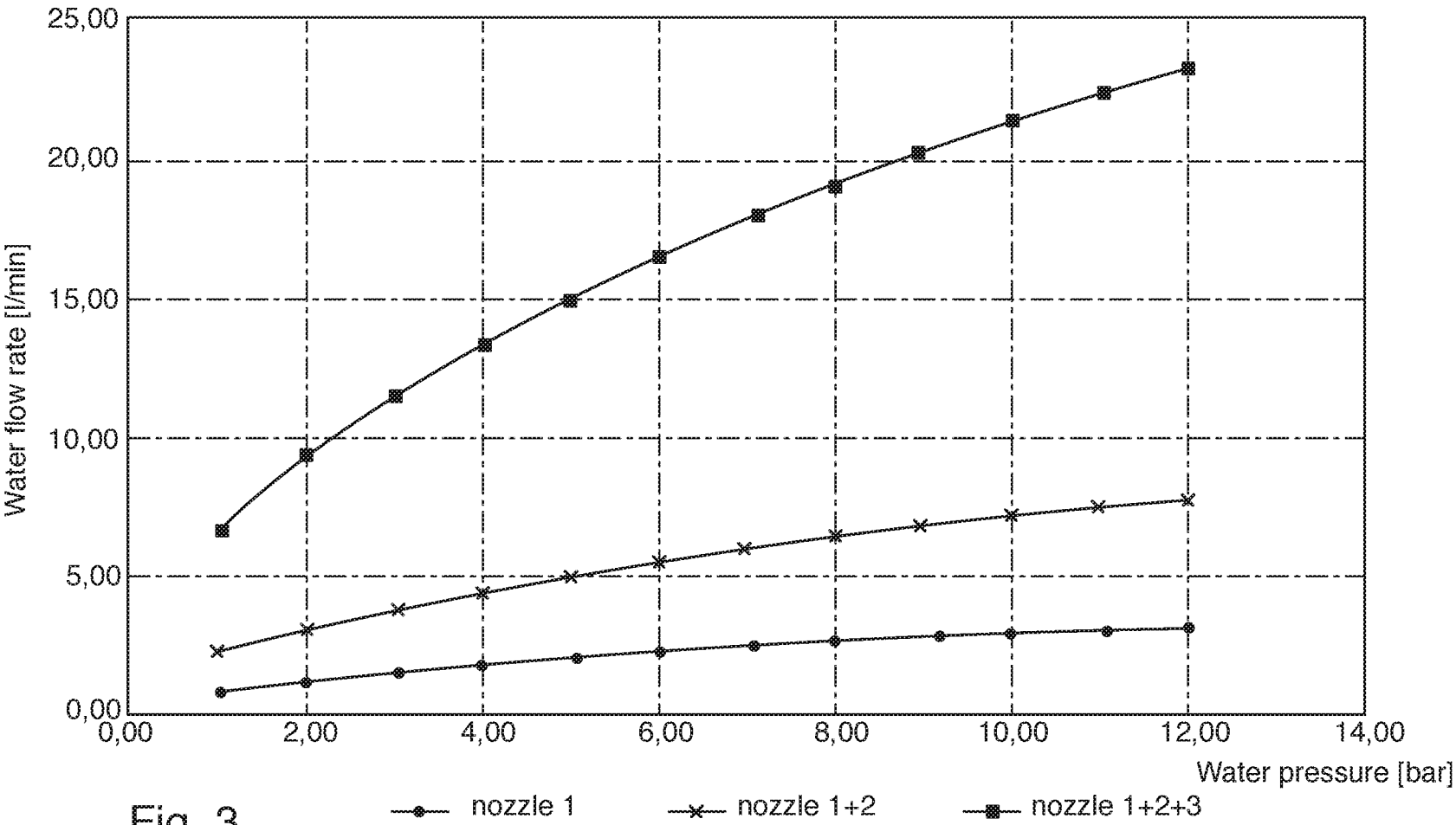
FIG. 3 shows a diagram for the purpose of explaining the range of spray-liquid quantity discharged which can be covered by the spray apparatus from FIG. 1.

FIG. 3 illustrates a diagram in which the spray-liquid quantity discharged is plotted in litres per minute over the water pressure of the spray liquid. A first line, which is provided with circles, shows the spray-liquid quantity discharged by the first nozzles 46 plotted over the water pressure. A second line, which is provided with crosses, shows the sum of the spray-liquid quantities discharged by the first nozzle 46 and the second nozzle 48. A third line, which is provided with squares, shows the sum of the spray-liquid quantities discharged by all three nozzles 46, 48, 50.

It can be seen that the first nozzle 46 discharges a spray-liquid quantity of merely approximately 1 l/min at a spray-liquid pressure of 1 bar. A spray-liquid quantity of approximately 3 l/min, then, is discharged at a spray-liquid pressure of 12 bar.

If the spray-liquid quantity discharged is to be increased above 3 l/min, the second nozzle 48 is switched on. At the same time, the spray-liquid pressure is reduced again to 1 bar.

It can be seen from the line provided with crosses that the sum of the spray-liquid quantities discharged by the first nozzle 46 and the second nozzle 48 is approximately 2 l/min at a spray-liquid pressure of 1 bar. This value is therefore lower than the spray-liquid quantity which is discharged by the first nozzle 46 alone at a spray-liquid pressure of 12 bar. The quantity ranges of the spray-liquid quantity discharged by the first nozzle 46 alone and of the spray-liquid quantities discharged by the first nozzle 46 and the second nozzle 48 together therefore overlap. This makes it possible to achieve a very precise setting of the spray-liquid quantity discharged by virtue of the spray-liquid pressure being varied and of individual nozzles 46, 48, 50 being switched on or off.

The first nozzle 46 and the second nozzle 48 together discharge approximately 7.5 l/min of spray liquid at a spray-liquid pressure of 12 bar, as can be seen on the far right of the line provided with crosses. If the intention then is for the spray-liquid quantity to be increased yet further, all three nozzles 46, 48, 50 are supplied with spray liquid and, at the same time, the spray-liquid pressure is reduced again to 1 bar. As can be seen with reference to the line provided with squares in FIG. 3, all three nozzles 46, 48, 50 together discharge a spray-liquid quantity of approximately 6 l/min at a spray-liquid pressure of 1 bar. Here too, therefore, the quantity ranges of the spray-liquid quantities discharged by the first nozzle 46 and the second nozzle 48 together and the quantity ranges of the spray-liquid quantities discharged by all three nozzles 46, 48, 50 together overlap. Of course, the spray-liquid quantity can be increased not just in the manner described; rather, it is also possible for nozzles to be switched on or off at different spray-liquid pressures, so that it is possible to set the desired spray quantity within the diagram of FIG. 3.

The nozzles 46, 48, 50 of the multiple-nozzle heads 44 are therefore coordinated with one another in respect of the spray-liquid quantity discharged such that the first nozzle, within a predefined pressure range between a low pressure and a high pressure of the spray liquid, discharges a spray-liquid quantity within a first quantity range, and that the sum of the spray-liquid quantities discharged by the first nozzle and the second nozzle at the low pressure is lower than the spray-liquid quantity discharged by the first nozzle at the high pressure. The quantity ranges of the spray-liquid quantities discharged by the first nozzle, on the one hand, and by the first nozzle and the second nozzle together, on the other hand, therefore overlap. Analogously, this is also the case for the sum of the spray-liquid quantities discharged by the first nozzle and the second nozzle at the high pressure and the sum of the spray-liquid quantities discharged by the first nozzle, the second nozzle and the third nozzle together at low pressure. This can be seen with reference to the line provided with squares in FIG. 3. This coordination of the spray-liquid quantities discharged can be achieved both by three identical nozzles 46, 48, 50 and by three nozzles 46, 48, 50 which differ in respect of the spray-liquid quantity discharged.

Figure 4:
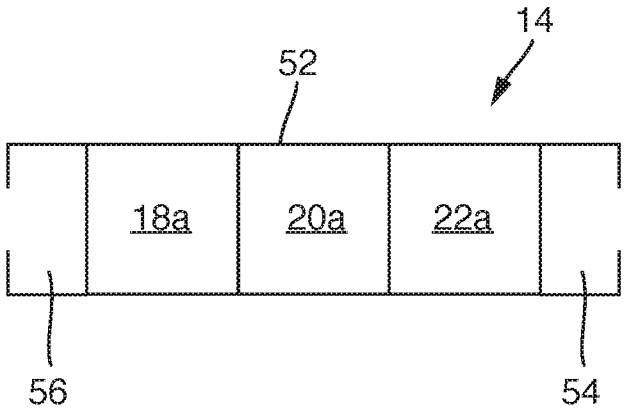
FIG. 4 shows a schematic illustration of a profile for forming a plurality of pipelines in the case of the spray apparatus according to the invention.

FIG. 4 shows, schematically, a front view of the support 14 from FIG. 1. The support 14 is formed by a profile 52, which has three hollow chambers which are continuous in the longitudinal direction. These three hollow chambers form the pipelines 18*a*, 20*a* and 22*a*, to which, as has been explained, the branch lines to the multiple-nozzle units 16 are then connected, or the multiple-nozzle unit 16 is connected directly.

It is also the case that respective undercut grooves 54, 56 are arranged laterally of the three hollow chambers or pipelines 18*a*, 20*a*, 22*a*. These undercut grooves 54, 56 can be used in order to mount, for example, the multiple-nozzle units 16 on the support 14. The support 42 from FIG. 2, which combines the three nozzle water pipes 18*b*, 20*b*, 22*b*, can be designed in the same or a similar manner in the form of a profile 52 with a plurality of hollow chambers.

Figure 5:
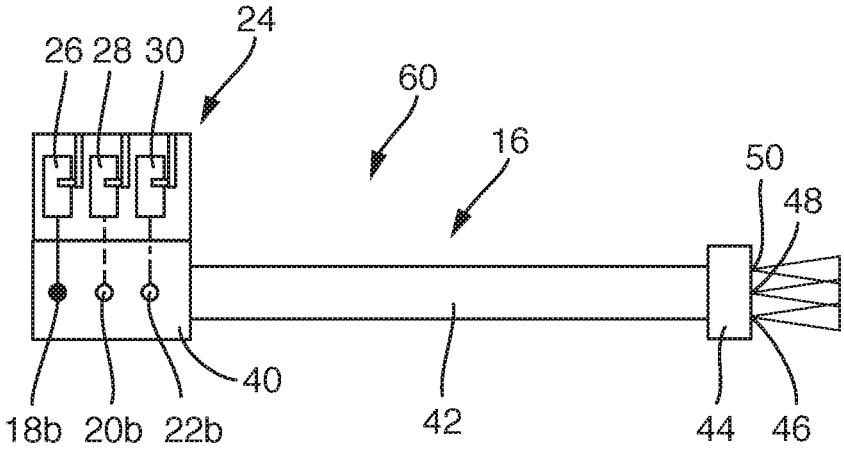
FIG. 5 shows a schematic illustration of a second embodiment of a spray apparatus according to the invention.

FIG. 5 shows a schematic illustration of a further embodiment of a spray apparatus 60 according to the invention.

The spray apparatus 60 has a multiple-nozzle unit 16, as has already been described with reference to FIG. 2. The multiple-nozzle unit 16 will therefore not be described anew.

In contrast to the multiple-nozzle unit 16 from FIG. 2, a nozzle valve block 24 with a total of three switching valves 26, 28 and 30 is arranged on the mounting block 40 of the multiple-nozzle unit 16, said nozzle valve block having already been explained with reference to the spray apparatus from FIG. 1.

The first switching valve 26 is assigned to a first nozzle water pipe 18*b*, the second switching valve 28 is assigned to a second nozzle water pipe 20*b* and the third switching valve 30 is assigned to a third nozzle water pipe 22*b*. A supply of spray water to the nozzle water pipes 18*b*, 20*b*, 22*b*, and therefore to the nozzles 46, 48 and/or 50 in the multiple-nozzle head 44, can thus be enabled or switched off via the switching valves 26, 28, 30.

For the sake of clarity, a supply of spray liquid to the nozzle valve block 24, a supply of compressed air to the nozzle valve block 24 and a possibly higher-level solenoid-valve island have not been illustrated in FIG. 5, but they have been provided in a manner identical to that in FIG. 1 and have been described in conjunction with FIG. 1.

The spray apparatus 60 according to FIG. 5 of the invention therefore has just one multiple-nozzle unit 16. Of course, within the framework of the invention, it is also nevertheless possible to combine a plurality of spray apparatuses 60 in an arrangement similar to FIG. 1. A plurality of spray apparatuses 60 are then provided for cooling a metal strand. In contrast to the spray apparatus 10 from FIG. 1, it is then possible, if a plurality of spray apparatuses 60 according to FIG. 5 are provided, for the individual multiple-nozzle units 16 to be activated separately from one another.

The invention claimed is:

1. A spray apparatus for cooling a metal strand in a continuous casting machine, the spray apparatus comprising at least one multiple-nozzle head and at least one switching valve, wherein the at least one multiple-nozzle head has at least a first and a second nozzle, wherein the at least one switching valve is arranged upstream of the at least one multiple-nozzle head, and wherein the at least one switching valve is flow-connected to the second nozzle in the at least one multiple-nozzle head, in order to enable or to shut off a supply of spray liquid to the second nozzle; further including a nozzle support and at least one multiple nozzle unit being connected in a releasable manner to the nozzle support, the nozzle support containing therein at least two pipelines, the at least one multiple nozzle unit having a mounting block in which a beginning of nozzle spray liquid pipes is arranged, the nozzle spray liquid pipes then leading to the at least one multiple-nozzle head, wherein the at least one multiple nozzle unit is connected in the releasable manner to the nozzle support by way of the mounting block.

2. The spray apparatus according to claim 1, wherein the at least one multiple-nozzle head comprises a plurality of multiple-nozzle heads, wherein the plurality of multiple-nozzle heads are spaced apart from one another in three dimensions.

3. The spray apparatus according to claim 1, wherein the at least one multiple-nozzle head comprises a plurality of multiple-nozzle heads, each of the plurality of multiple-nozzle heads includes the first nozzle and at least one flow control nozzle including at least the second nozzle, wherein each at least one flow control nozzle of every one of the plurality of multiple-nozzle heads comprises a set of flow control nozzles, each set of the flow control nozzles being flow-connected to one of the at least one switching valve in order to enable or to shut off the supply of spray liquid to each particular set of flow control nozzles, wherein the at least one flow control nozzle comprises no more than 9 flow control nozzles.

4. The spray apparatus according to claim 1, wherein the at least one switching valve comprises at least a first and a second switching valve, wherein the first switching valve is flow-connected to each first nozzle in the at least one multiple-nozzle head, in order to enable or to shut off the supply of spray liquid to each first nozzle, and wherein the second switching valve is flow-connected to each second nozzle in the at least one multiple-nozzle head in order to enable or to shut off the supply of spray liquid to each second nozzle.

5. The spray apparatus according to claim 1, wherein the at least two pipelines comprises a first pipeline and a second pipeline, and the first pipeline is connected to each first nozzle and the second pipeline is connected to each second nozzle.

6. The spray apparatus according to claim 5, wherein the at least one multiple-nozzle head comprises a plurality of multiple-nozzle heads and the at least one switching valve comprises a plurality of switching valves, and upstream of the plurality of multiple-nozzle heads, a first one of the plurality of switching valves is provided on the second pipeline and each remaining one of the plurality of switching valves is provided to each one of at least one further pipeline of the at least two pipelines, the at least one further pipeline being less than 9 pipelines.

7. The spray apparatus according to claim 5, wherein the at least one multiple-nozzle head comprises a plurality of multiple-nozzle heads and upstream of the plurality of multiple-nozzle heads, one of the at least one switching valve is provided on the first pipeline.

8. The spray apparatus according to claim 1, wherein the at least one multiple-nozzle head comprises a plurality of multiple-nozzle heads, each of the at least two pipelines being connected to a set of the nozzles, each of the set of nozzles including at least one of the nozzles in each of the at least one multiple-nozzle heads such that a first one of the set of the nozzles includes each first nozzle in each of the multiple-nozzle heads and a second one of the set of nozzles includes each second nozzle in each of multiple-nozzle heads, the at least two pipelines being no more than 10 pipelines.

9. The spray apparatus according to claim 1, wherein the first and second nozzle of the at least one multiple-nozzle head differ to an extent where, at a predefined pressure of the spray liquid, each of the first and second nozzle discharge a different quantity of spray liquid.

10. The spray apparatus according to claim 1, wherein the first and second nozzle of the at least one multiple-nozzle head are coordinated with one another in respect of a spray-liquid quantity discharged such that the first nozzle, within a predefined pressure range between a low pressure and a high pressure of the spray liquid, discharges a spray-liquid quantity within a first quantity range, and that a second quantity range made up of a sum of spray-liquid quantities discharged by the first nozzle and the second nozzle between the low pressure and the high pressure overlaps the first quantity range.

11. The spray apparatus according to claim 1, wherein each at least one multiple-nozzle head has a plurality of nozzles including at least the first and second nozzle, wherein each of the plurality of nozzles, within a predefined pressure range between a low pressure and a high pressure of the spray liquid, discharge a spray-liquid quantity within a quantity range, and that the quantity ranges overlap, and wherein there are not more than 10 quantity ranges.

12. The spray apparatus according to claim 1, wherein the at least one multiple-nozzle head comprises a plurality of multiple-nozzle heads, each of the multiple-nozzle heads being spaced apart from one another in three dimensions along the at least two pipelines.

13. The spray apparatus according to claim 1, wherein the at least two pipelines are configured to run parallel to a casting direction of the continuous casting machine and the at least one multiple-nozzle head comprises a plurality of multiple-nozzle heads arranged along the at least two pipelines one behind another in the casting direction.

14. The spray apparatus according to claim 1, wherein the at least two pipelines are arranged transversely to a casting direction of the continuous casting machine and the at least one multiple-nozzle head comprises a plurality of multiple-nozzle heads arranged along the at least two pipelines one behind another transversely to the casting direction.

15. The spray apparatus according to claim 1, wherein the at least one switching valve comprises a compressed-air valve, and in that each at least one switching valve is assigned a solenoid valve for enabling or shutting off a supply of compressed air to the each at least one switching valve.

16. The spray apparatus according to claim 15, wherein each solenoid valve is combined in a solenoid-valve island, wherein the solenoid-valve island has a joint base and a joint electronic control for the each solenoid valve.

17. The spray apparatus according to claim 1, wherein at least one of the at least two pipelines has a profile with at least one hollow chamber which is continuous in a longitudinal direction of the profile.

18. The spray apparatus according to claim 17, wherein the at least one multiple-nozzle head is arranged on the profile or on a support having the profile.

19. The spray apparatus according to claim 1, wherein the least two pipelines have profiles with a plurality of hollow chambers which are continuous in a longitudinal direction.

20. The spray apparatus according to claim 19, wherein the profiles are connected to form a support.

21. A method for cooling a metal strand in a continuous casting machine by the spray apparatus according to claim 1, wherein the at least one multiple-nozzle head comprises a plurality of multiple-nozzle heads, the method comprising: enabling the supply of spray liquid and/or switching off the supply of spray liquid to each second nozzle in dependence on a spray-liquid quantity required, wherein enabling and/or switching off the supply of spray liquid is carried out exclusively when the spray-liquid quantity required is altered.

22. The method according to claim 21, further comprising enabling the supply of spray liquid or switching off the supply of spray liquid to each first nozzle in dependence on the spray-liquid quantity required, wherein enabling and/or switching off the supply of spray liquid is carried out exclusively when the spray-liquid quantity required is altered.

23. A spray apparatus for cooling a metal strand in a continuous casting machine, the spray apparatus comprising:

a first switching valve and a second switching valve;

a nozzle support; and a plurality of multiple nozzle units being releasably connected to the nozzle support;

each of the multiple nozzle units including a multiple-nozzle head, each multiple-nozzle head having a first nozzle and a second nozzle;

the first switching valve and the second switching valve being located upstream of the each of the multiple nozzle units;

the first switching valve being flow-connected to each first nozzle in order to enable or to shut off a first supply of spray liquid to every first nozzle;

the second switching valve being flow-connected to each second nozzle in order to enable or to shut off a second supply of spray liquid to every second nozzle;

the nozzle support containing therein at least two pipelines;

each of the multiple nozzle units having a mounting block with a beginning of nozzle spray liquid pipes therein, with the nozzle spray liquid pipes then leading to the multiple-nozzle head; and the mounting block releasably connecting each multiple nozzle unit to the nozzle support.

* * * * *